US006296443B1

(12) United States Patent
Newman et al.

(10) Patent No.: US 6,296,443 B1
(45) Date of Patent: Oct. 2, 2001

(54) VANE SECTOR SEATING SPRING AND METHOD OF RETAINING SAME

(75) Inventors: Shawn T. Newman; Gary R. Peters, both of Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/454,707

(22) Filed: Dec. 3, 1999

(51) Int. Cl.[7] ..... F01D 9/00

(52) U.S. Cl. ..... 415/209.2; 415/209.3; 415/189; 415/190

(58) Field of Search ..... 415/189, 190, 415/209.2, 209.3, 209.4, 210.1

(56) References Cited

U.S. PATENT DOCUMENTS 5,846,050 12/1998 Schilling ..... 415/135

*Primary Examiner*—Edward K. Look
*Assistant Examiner*—James M McAleenan
(74) *Attorney, Agent, or Firm*—Andrew C. Hess; Rodney M. Young

(57) ABSTRACT

A seating spring is provided for a gas turbine engine compressor stator having a casing with a circumferential casing slot for mounting a plurality of vane sectors at outer bands thereof. The seating spring has at least one reaction tab configured to abut the casing at one side of the casing slot and a spring arm connected to the reaction tab and configured to abut a respective one of the outer bands to bias the outer band against the casing at a second side of the casing slot. A retention arm is connected to the reaction tab and engages the casing so as to be prevented from moving radially outward. The spring arm is thereby retained in contact with the outer band.

17 Claims, 4 Drawing Sheets

VANE SECTOR SEATING SPRING AND METHOD OF RETAINING SAME

STATEMENT REGARDING FEDERALLY SPONSORED RESEARCH & DEVELOPMENT

The U.S Government may have certain rights in this invention pursuant to contract number F33657-97-C-0016 awarded by the Department of the Air Force.

BACKGROUND OF THE INVENTION

This invention relates generally to gas turbine engines and more particularly to compressor stators used in such engines.

A gas turbine engine includes a compressor typically including a plurality of axial stages that compress airflow in turn. A typical axial compressor includes a split outer casing having two 180 degree segments that are suitably bolted together at axial splitlines. The casing includes rows of axially spaced apart casing slots that extend circumferentially therearound for mounting respective rows of vane segments or sectors.

A typical vane sector includes radially outer and inner bands between which are attached a plurality of circumferentially spaced apart stator vanes. The outer band includes a pair of axially spaced apart forward and aft rails, which are typically L-shaped with corresponding forward and aft hooks. The casing includes complementary forward and aft grooves that extend circumferentially within each of the casing slots for receiving the corresponding rails in a tongue-and-groove mounting arrangement.

During assembly, the individual vane sectors are circumferentially inserted into respective ones of the casing halves by engaging the forward and aft hooks with the corresponding forward and aft grooves. Each vane sector is slid circumferentially in turn into the casing slot until all of the vane sectors in each casing half are assembled. The two casing halves are then assembled together so that the vane sectors in each casing slot define a respective annular row of adjoining sectors for each compression stage.

A conventional compressor rotor having corresponding rows of compressor blades is suitably disposed within the compressor stator. Conventional sealing shrouds or segments are suitably attached to the radially inner bands of the vane sectors to cooperate with labyrinth teeth extending from the compressor rotor for effecting interstage seals.

In this configuration, the individual vane sectors are mounted to the outer casing solely by their outer bands, with the vanes and inner bands being suspended therefrom. The tongue-and-groove mounting arrangement therefore requires suitable clearance for not only allowing assembly of the vane sectors, but for also allowing differential thermal expansion and contraction between the components during operation of the compressor.

Typical manufacturing tolerances and stack-up thereof create clearances or gaps between the outer bands and the casing. During operation, air is compressed in each of the compressor stages and effects tangential and axially forward resultant aerodynamic loads acting on the vane sectors. The axial load urges the vane sectors forwardly and is reacted by axial engagement between the forward rail and the forward side of the casing slot, while increasing the axial gap between the aft side of the casing slot and the outer band. The tangential load is reacted by a typical anti-rotation key disposed in the casing slot at a casing splitline.

Since the compressor rotor excites vibratory response of the vane sectors during operation, and the vane sectors experience differential thermal expansion and contraction relative to the casing, the interfacing components thereof are subject to vibratory and thermal movement which may cause frictional wear. In order to reduce such frictional wear, conventional wear coatings or wear shims are provided. However, the coatings and shims are also subject to typical manufacturing tolerances and stack-up clearances, and do not abate the underlying frictional wear mechanism.

A useful approach to remedying this wear problem is described in U.S. Pat. No. 5,846,050 issued Dec. 8, 1998 to Jan C. Schilling. The Schilling patent discloses a seating spring for a compressor vane sector. The seating spring includes a reaction tab configured to abut the compressor casing on one side of the casing slot. At least one resilient spring arm is fixedly joined to the reaction tab and is configured to abut one of the outer bands so as to bias that outer band against the casing on an opposite side of the casing slot. Thus, the seating spring reduces wear by minimizing axial free play between the vane sectors and the stator casing while allowing differential thermal expansion and contraction during operation. However, it is possible for the tip of the resilient spring arm to work its way radially outward and ultimately lose contact with the outer band. If this were to happen, then the outer band would not be biased against the casing, and the seating spring would not function in its intended manner.

Accordingly, there is a need for a vane sector seating spring that eliminates the possibility of losing contact with the outer band of the vane sector.

BRIEF SUMMARY OF THE INVENTION

The above-mentioned need is met by the present invention which provides a seating spring for a gas turbine engine compressor stator having a casing with a circumferential casing slot for mounting a plurality of vane sectors at outer bands thereof. The seating spring has at least one reaction tab configured to abut the casing at one side of the casing slot and a spring arm connected to the reaction tab and configured to abut a respective one of the outer bands to bias the outer band against the casing at a second side of the casing slot. A retention arm is connected to the reaction tab and engages the casing so as to be prevented from moving radially outward. The spring arm is thereby retained in contact with the outer band.

The present invention and its advantages over the prior art will become apparent upon reading the following detailed description and the appended claims with reference to the accompanying drawings.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
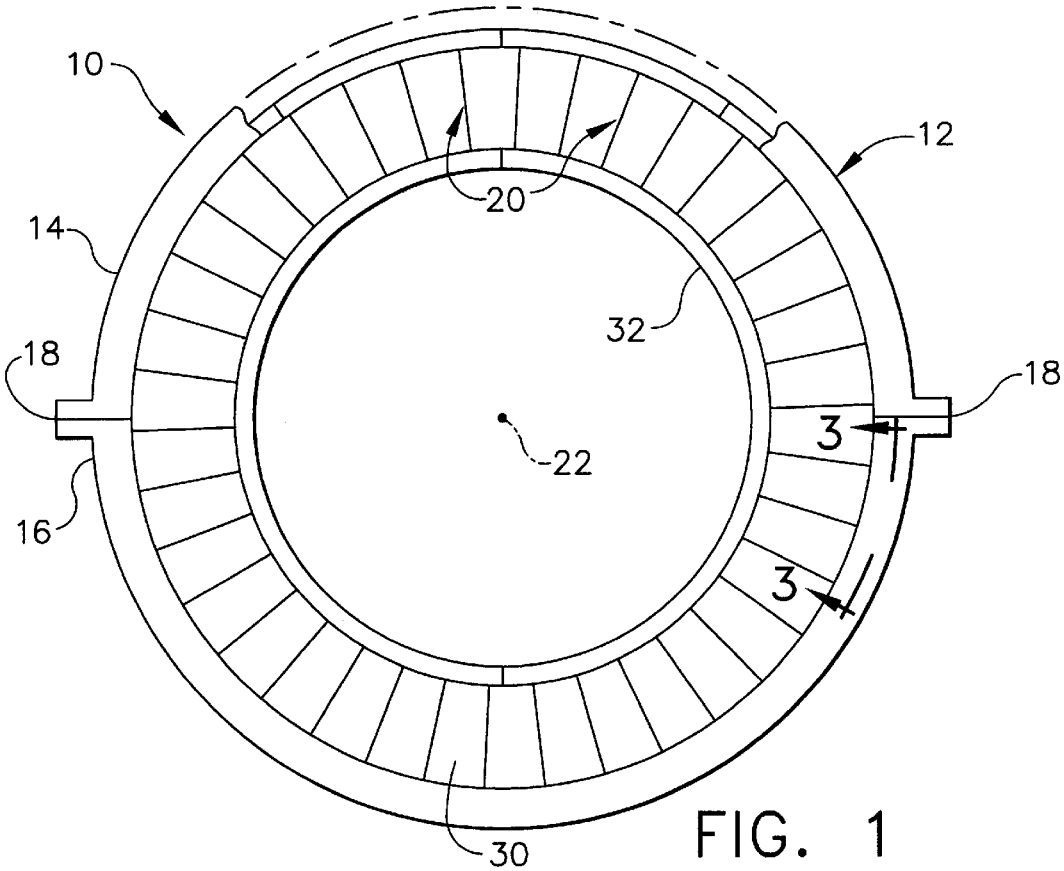
FIG. 1 is an elevational view through a portion of a gas turbine engine compressor stator having a plurality of circumferentially adjoining vane sectors mounted therein in accordance with the present invention.

Referring to the drawings wherein identical reference numerals denote the same elements throughout the various views, FIG. 1 shows a compressor stator 10 for an axial flow compressor in a gas turbine engine (not shown). The stator 10 includes an annular outer casing 12 conventionally formed in two 180 degree halves 14, 16 which are conventionally fixedly joined together along a pair of opposing axial splitlines 18. A plurality of circumferentially adjoining vane sectors 20 are mounted to the casing 12 to form a single row disposed coaxially about a longitudinal centerline axis 22 of the stator 10.

Figure 2:
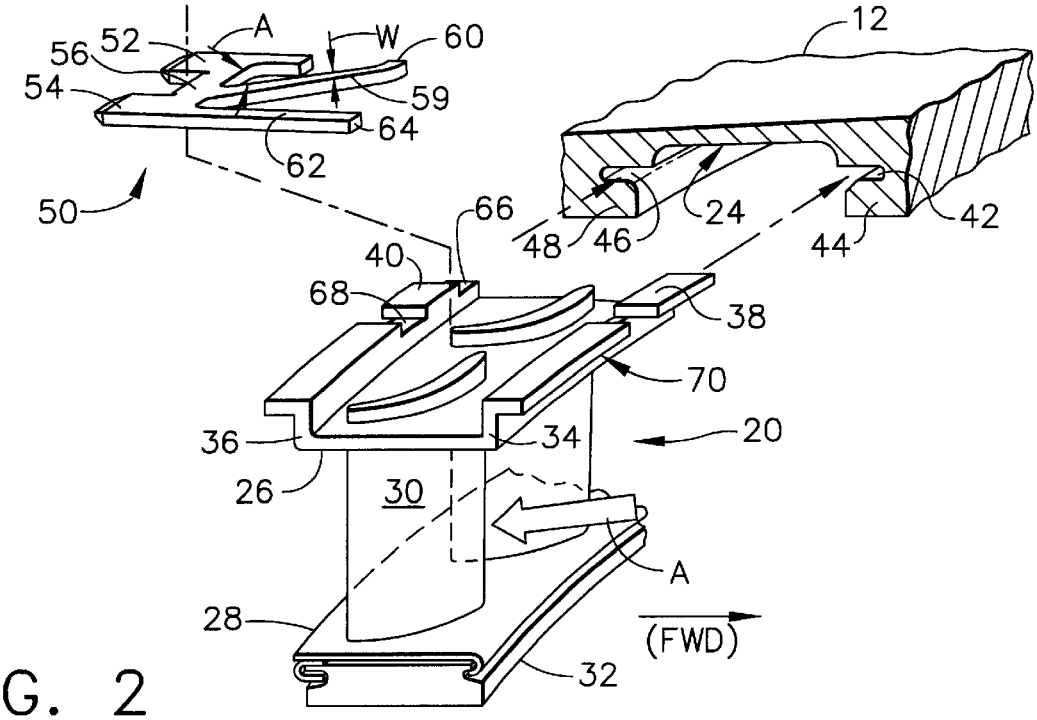
FIG. 2 is an exploded view of a portion of the compressor stator illustrated in FIG. 1 showing assembly of an individual vane sector into an outer casing with a seating spring for biasing the vane sector in an axially forward direction.

As shown in FIG. 2, the casing 12 includes a circumferential casing slot 24 configured for removably mounting the vane sectors 20 in a tongue-and-groove manner for allowing ready assembly and disassembly thereof. Each vane sector 20 includes an arcuate radially outer band 26 and an arcuate radially inner band 28 spaced therefrom and between which are fixedly mounted a plurality of circumferentially spaced apart stator vanes 30. The vanes 30 may be joined to the outer and inner bands in any conventional fashion and typically include five or more vanes per sector, for example. The inner bands 28 may have any conventional form for suitably mounting conventional sealing shrouds or segments 32 which cooperate with conventional labyrinth teeth of a cooperating compressor rotor (not shown). Each of the outer bands 26 includes forward and aft outer rails 34, 36 that extend circumferentially therealong. The rails 34, 36 are generally L-shaped in cross-section, with the forward rail 34 having an axially extending forward rail hook 38, and the aft rail 36 having an axially extending aft rail hook 40.

The casing 12 includes a forward groove 42 that extends circumferentially within the casing slot 24 and also extends axially forward therefrom to define a respective forward casing hook 44. The casing 12 also includes an aft groove 46 that extends circumferentially within the casing slot 24 and also extends axially aft therefrom to define a corresponding aft casing hook 48.

The forward rail hook 38 extends forwardly from the outer band 26 and is configured to slidingly engage the casing forward groove 42 in a conventional tongue-and-groove arrangement. Similarly, the aft rail hook 40 extends in an aft direction and is configured to slidingly engage the casing aft groove 46 in a conventional tongue-and-groove arrangement. The terms forward and aft as used herein are relative to the primary direction of airflow (represented by arrow A in FIG. 2) traveling downstream between the vanes 30 of each of the compressor stages. As the airflow travels downstream, it is compressed in turn by each succeeding stage of the compressor for elevating its pressure. The tongue-and-groove mounting arrangement of the vane sectors 20 in the casing 12 necessarily includes manufacturing tolerances on the individual components thereof which result in stack-up clearances when assembled.

To reduce or eliminate the axial component of such stack-up clearances, and thereby reduce or eliminate axial free-play between the outer bands 26 and the casing 12, the present invention includes a removable seating spring 50. The seating spring 50 is specifically configured to cooperate with the casing 12 and the outer bands 26 to preferentially bias the vane sectors 20 in their mounting slots 24. Minor modifications to the outer bands 26 may be made for allowing retrofit of the seating spring 50 in an otherwise conventional mounting arrangement.

Figure 3:
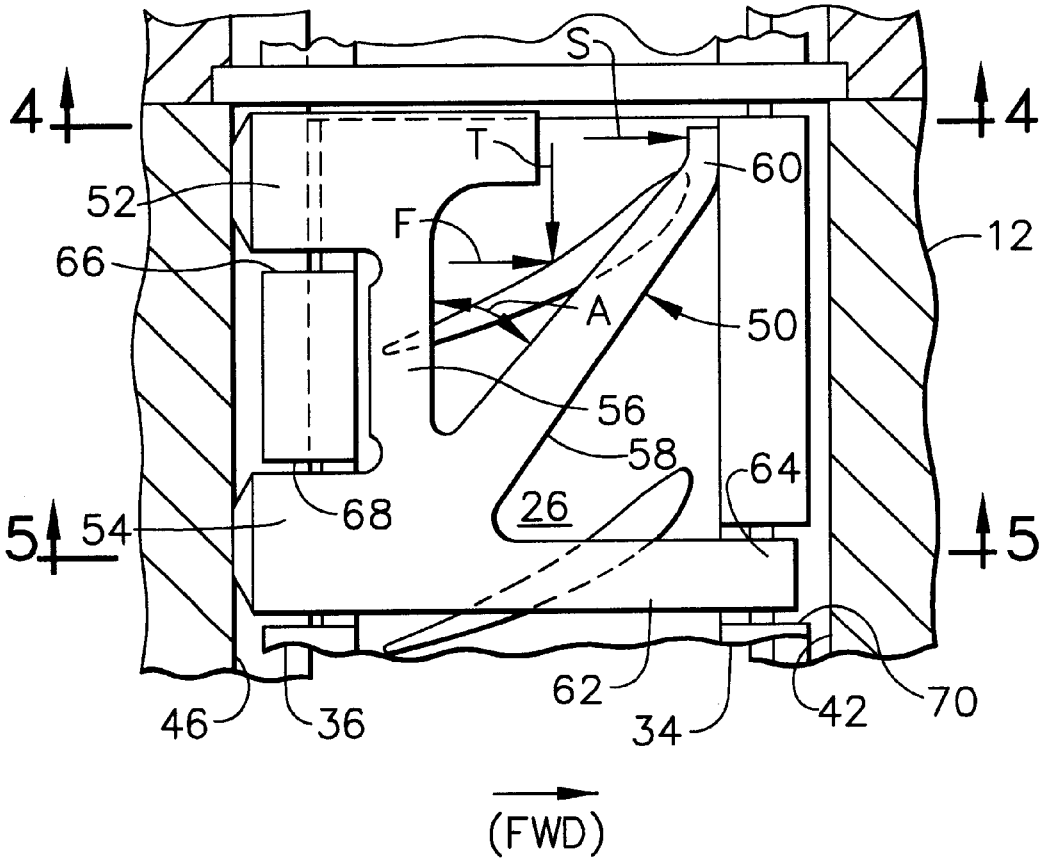
FIG. 3 is a radial view of a portion of the compressor stator illustrated in FIG. 1 and taken generally along line 3—3 showing the seating spring of the present invention.

Referring to FIGS. 2 and 3, the seating spring 50 preferably includes a first reaction tab 52 and a second reaction tab 54 fixedly joined together by a connector arm 56. The first and second reaction tabs 52 and 54 are configured to abut or engage the casing 12 at the aft side of the casing slot 24. A resilient or flexible spring arm 58 is fixedly joined to the second reaction tab 54 (and is thus connected to the first reaction tab 52) and includes a tip 60 at an opposite distal end for engaging the outer band 26, preferably on the backside of the forward rail 34. The spring arm 58 preferably tapers or converges in size or width W from the second reaction tab 54 to the tip 60 to provide a variable spring rate increasing in magnitude as the tip 60 is compressed toward the first reaction tab 52. The spring arm 58 is preferably inclined at an acute angle A from the connector arm 56, which extends in the circumferential direction, to effect cantilever spring flexibility relative thereto. For example, the inclination angle A may be about 45 degrees.

The seating spring 50 further includes a retention arm 62 that is also fixedly joined to the second reaction tab 54 (and is thus connected to the first reaction tab 52), circumferentially outside of the spring arm 58. The retention arm 62 extends axially forward from the second reaction tab 54, preferably at a 90 degree angle to the connector arm 56. The distal end 64 of the retention arm 62 engages the forward groove 42 of the casing 12 in a manner described in more detail below.

As seen best in FIGS. 2 and 3, the aft rail 36 includes a first cutout or notch 66 preferably extending axially through the aft hook 40 for allowing the first reaction tab 52 to directly abut the casing 12 at the aft side of the casing slot 24 in the aft groove 46. Similarly, the aft rail 36 includes a second cutout or notch 68 preferably extending axially through the aft hook 40 for receiving the second reaction tab 54 and allowing it to directly abut the casing 12 at the aft side of the casing slot 24 in the aft groove 46. The spring arm 58 correspondingly extends axially between the aft and forward rails 36, 34 to abut the backside of the forward rail 34 along the forward rail hook 38. A third cutout or notch 70 is formed in the forward rail 34 for receiving the distal end 64 of the retention arm 62.

Figure 4:
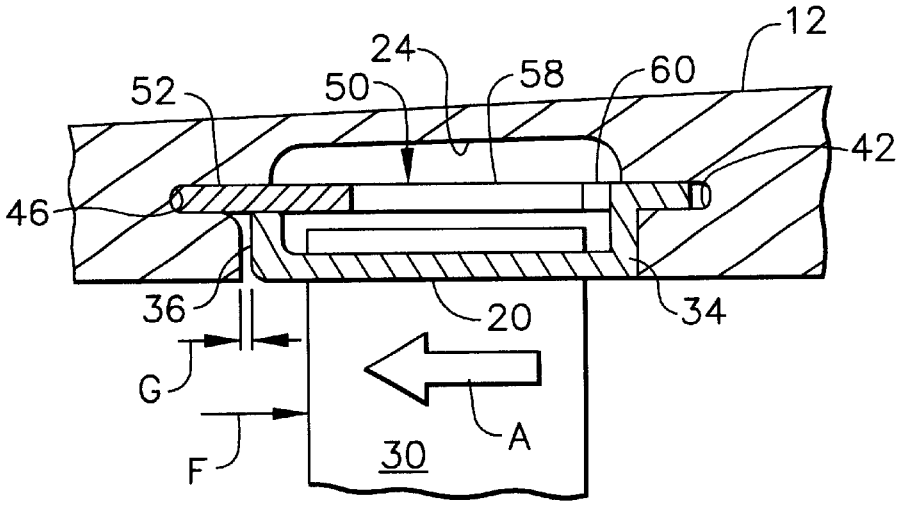
FIG. 4 is an elevational, partly sectional view through the stator portion illustrated in FIG. 3 and taken along line 4—4.

As shown in FIGS. 3 and 4, the first reaction tab 52 therefore extends through the first notch 66 to engage the aft groove 46 and the second reaction tab 54 extends through the second notch 68 to engage the aft groove 46. The spring arm 58 extends axially between the aft and forward hooks 40, 38 to engage the backside of the forward hook 38 and thereby bias the outer band 26 toward the casing forward groove 42. Thus, the outer band 26 is biased against the casing 12 at the forward groove 42 so that axial free-play is reduced or eliminated. However, since the first and second reaction tabs 52 and 54 frictionally engage the aft groove 46, and the spring arm tip 60 frictionally engages the forward rail 34, the outer band 26 remains free to expand and contract circumferentially relative to the casing 12 in the slot 24 without undesirable restraint.

As shown in FIG. 3, the connector arm 56 extends parallel to the backside of the aft rail 36 with a suitably small axial gap therebetween. Tangential movement of the outer band 26 will develop a moment or couple around the seating spring 50 which may be reacted by contact of the connector arm 56 against the backside of the aft rail 36 which stabilizes the seating spring 50 during operation.

Figure 5:
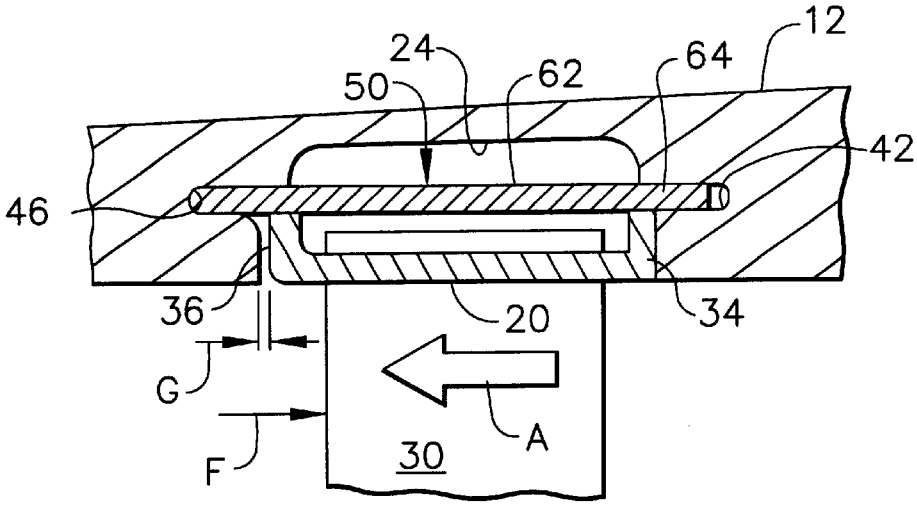
FIG. 5 is an elevational, partly sectional view through the stator portion illustrated in FIG. 3 and taken along line 5—5.

As shown in FIGS. 3 and 5, the distal end 64 of the retention arm 62 is received in the third notch 70, and thus extends into the forward groove 42, thereby engaging the casing 12. Because the distal end 64 is located within the forward groove 42, the retention arm 62 is prevented from moving radially outward. This means that the spring arm tip 60 will retain contact with the outer band 26.

The first reaction tab 52, the second reaction tab 54, the connector arm 56, the spring arm 58 and the retention arm 62, which collectively make up the seating spring 50, are preferably joined together in an integral one-piece plate form. The seating spring 50 may be formed of a suitable metal and configured and sized to effect a suitable spring force S against the forward rail 34 of the outer band 26.

The individual seating springs 50 may be simply mounted atop the respective outer bands 26 during assembly into the casing slot 24. The initial compression of the spring arm 58 effects the spring force S which will bias the outer band 26 at the forward rail 34 in axial engagement against the casing 12 at the forward groove 42 as illustrated in more particularity in FIG. 4. Accordingly, an axial gap G remains between the aft rail 36 and the casing 12 at the aft groove 46. If desired, the first and second reaction tabs 52 and 54 may have suitable lead-ins or chamfers at the circumferentially opposite corners thereof as illustrated in FIG. 3 to improve assembly of the individual seating springs 50 as they are compressed into position.

The airflow travels forward-to-aft and effects a resultant axial force F that acts on the vanes 30 in the aft-to-forward direction. As the compressor is operated at higher speed with a corresponding increase in the resultant axial force F, that axial force F alone will be effective to maintain seating of the outer band 26 against the forward side of the casing slot 24 with minimal vibratory movement therebetween. However, at relatively low aerodynamic loading of the vanes 30 the resultant axial force F may not be adequate to restrain axial vibratory motion of the outer band 26, and therefore the seating spring 50 provides a suitable additional axial force S to maintain the axially aft seating of the outer band 26 in the slot 24. Accordingly, the seating spring 50 need only be sized for providing a relatively small seating force S during light aerodynamic loading of the vanes 30. The spring 50 may then prevent undesirable axial movement of the outer band 26 during operation that would otherwise promote frictional wear. Conventional wear coatings or shims may therefore be eliminated if desired.

Transient operation of the compressor results in differential temperatures across the components thereof, which causes differential thermal expansion and contraction. At steady state operation with the components being stabilized at a uniform temperature, differential movements are eliminated. Accordingly, the spring arm 58 may alternatively be a different material than the remainder of the seating spring 50 having different coefficients of thermal expansion so that the axial force S exerted on the sector during transient operation may be optimized, and is different than the axial force exerted once the compressor is stabilized at steady state.

Figure 6:
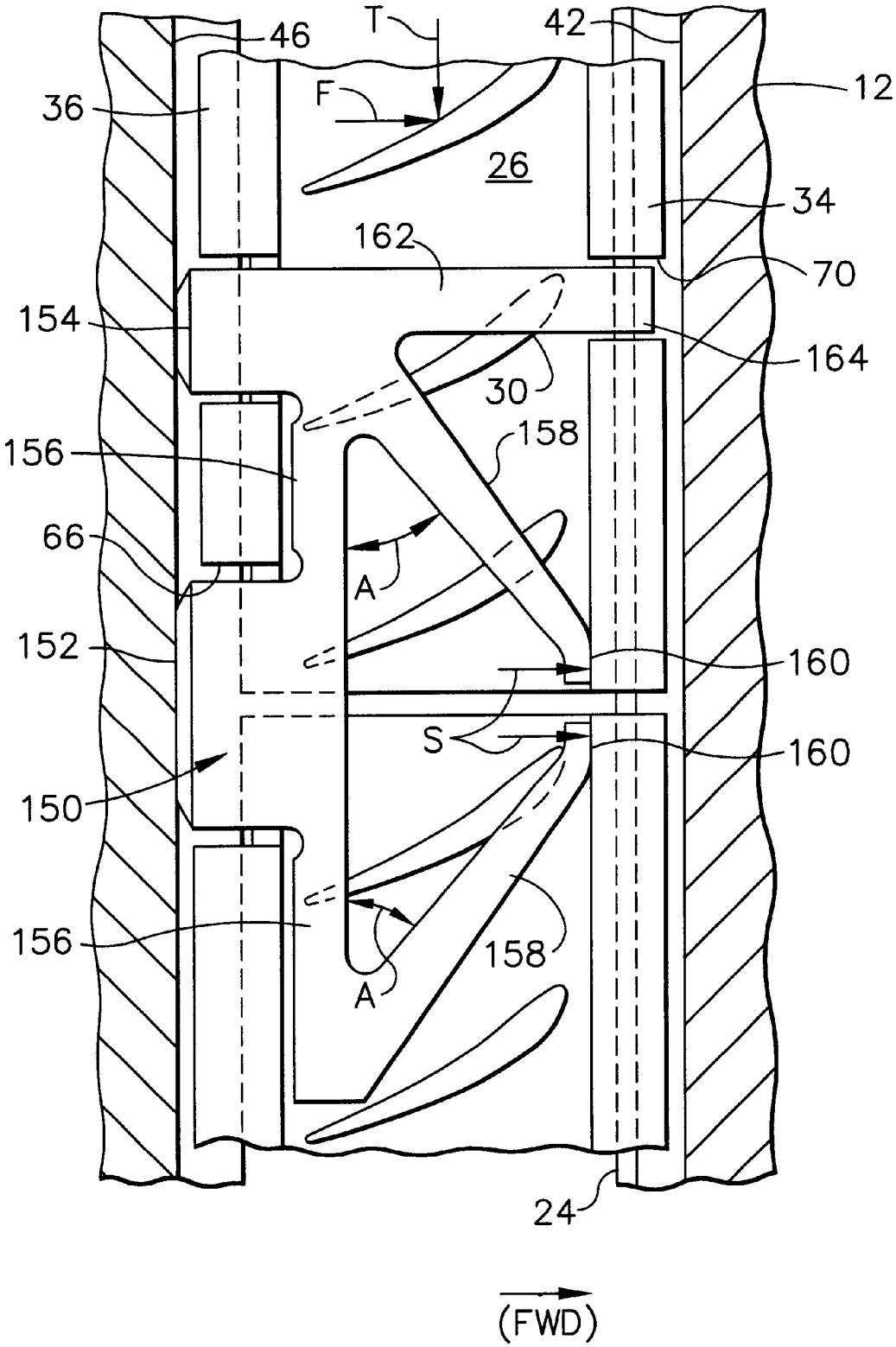
FIG. 6 is a radial view of a portion of a compressor stator showing a second embodiment of the seating spring of the present invention.

Referring to FIG. 6, an alternative embodiment is shown. In this embodiment, a seating spring 150 is provided to reduce or eliminate axial free-play in a pair of adjacent vane sectors 20. The seating spring 150 includes a first reaction tab 152 and a second reaction tab 154 fixedly joined together by a connector arm 156. A second connector arm 156 extends from the first reaction tab 152 in the opposite circumferential direction. The first and second reaction tabs 152 and 154 are configured to abut against the casing 12 at the aft side of the casing slot 24. A pair of flexible spring arms 158 extend circumferentially inwardly from the respective connectors arms 156, which extend in the circumferential direction, at acute angles A thereto. Each spring arm 158 includes a tip 160 at its distal end for engaging the outer band 26 of a respective one of the vane sectors 20. Thus, the spring arms 158 bias the respective outer bands 26 against the casing 12 at the forward groove 42 so that axial free-play is reduced or eliminated in each of the adjacent vane sectors 20.

The seating spring 150 further includes a retention arm 162 that is fixedly joined to the second reaction tab 154. The retention arm 162 extends axially forward from the second reaction tab 154, preferably at a 90 degree angle to the connector arm 156. The distal end 164 of the retention arm 162 is received in a notch 70 formed in the forward rail 34 of the corresponding outer band 26. As is the first embodiment, the distal end 164 is consequently located within the forward groove 42 and engages the casing 12 so that the retention arm 162 will be prevented from moving radially outward. This means that the spring arm tips 160 will remain in contact with their respective outer bands 26. Although the retention arm 162 is shown as being fixedly joined to the second reaction tab 154, it could alternatively be fixedly joined to the opposite end of the other connector arm 156 and thus engage the outer band 26 of the other vane sector 20.

The various embodiments of the seating springs disclosed above provide various advantages in a relatively simple assembly which may be readily retrofitted to conventional designs if desired. The springs provide positive axial seating loads on the individual sectors, while allowing the sectors to move axially and circumferentially for thermal excursions. Conventional wear coating or wear shims may be eliminated in view of the reduced vibratory motion of the vane sectors effected by the seating springs. The provision of the retention arm insures that the spring arm tips will be retained in contact with the outer bands. The seating spring itself, since it fictionally engages the casing and the outer band, inherently provides damping for the individual vane sectors which is not otherwise provided.

While specific embodiments of the present invention have been described, it will be apparent to those skilled in the art that various modifications thereto can be made without departing from the spirit and scope of the invention as defined in the appended claims.

What is claimed is:

1. In a gas turbine engine compressor stator including a casing with a circumferential casing slot for mounting a plurality of vane sectors at outer bands thereof, a seating spring comprising:

a first reaction tab configured to abut said casing at one side of said casing slot;

a spring arm connected to said first reaction tab and configured to abut a respective one of said outer bands to bias said one outer band against said casing at a second side of said casing slot; and a retention arm connected to said first reaction tab and configured to engage said casing.

2. The seating spring of claim 1 wherein said first reaction tab is configured to be received in a notch formed in said one outer band.

3. The seating spring of claim 1 further comprising a second reaction tab and a connector arm connecting said second reaction tab to said first reaction tab.

4. The seating spring of claim 3 wherein said second reaction tab is configured to abut said casing at one side of said casing slot.

5. The seating spring of claim 3 wherein said retention arm is fixedly joined to said second reaction tab.

6. The seating spring of claim 5 wherein said retention arm forms a 90 degree angle with said connector arm.

7. The seating spring of claim 1 further comprising a second spring arm connected to said first reaction tab and configured to abut a second one of said outer bands to bias said second outer band against said casing at said second side of said casing slot.

8. A gas turbine engine compressor stator comprising:

a casing having a circumferential casing slot formed therein, said casing slot including forward and aft grooves extending circumferentially along said casing slot on opposite sides thereof;

a plurality of vane sectors mounted in said casing slot, each one of said vane sectors including an outer band having a forward rail received within said forward groove and an aft rail received within said aft groove; and at least one seating spring including a first reaction tab configured to abut said casing at one side of said casing slot, a spring arm connected to said first reaction tab and configured to abut a respective one of said outer bands to bias said one outer band against said casing at a second side of said casing slot, and a retention arm connected to said first reaction tab and configured to engage said casing.

9. The gas turbine engine compressor stator of claim 8 wherein said forward rail has a notch formed therein and said retention arm has a distal end that is received in said notch.

10. The gas turbine engine compressor stator of claim 9 wherein said distal end is located in said forward groove.

11. The gas turbine engine compressor stator of claim 8 wherein said seating spring further includes a second reaction tab and a connector arm connecting said second reaction tab to said first reaction tab.

12. The gas turbine engine compressor stator of claim 11 wherein said second reaction tab is configured to abut said casing at one side of said casing slot.

13. The gas turbine engine compressor stator of claim 11 wherein said retention arm is fixedly joined to said second reaction tab.

14. The gas turbine engine compressor stator of claim 13 wherein said retention arm forms a 90 degree angle with said connector arm.

15. The gas turbine engine compressor stator of claim 8 wherein said seating spring further includes a second spring arm connected to said first reaction tab and configured to abut a respective a second one of said outer bands to bias said second outer band against said casing at said second side of said casing slot.

16. In a gas turbine engine compressor stator including a casing having a circumferential casing slot formed therein, said casing slot including forward and aft grooves extending circumferentially along said casing slot on opposite sides thereof, a plurality of vane sectors mounted in said casing slot, each one of said vane sectors including an outer band having a forward rail received within said forward groove and an aft rail received within said aft groove, and at least one seating spring having a spring arm for biasing a respective one of said outer bands against said casing at a second side of said casing slot, a method of retaining said spring arm in contact with said outer band, said method comprising the steps of:

providing said at least one seating spring with a retention arm; and locating a distal end of said retention arm in one of said forward and aft grooves so as to prevent said retention arm from moving radially outward.

17. The method of claim 16 wherein said distal end of said retention arm is located in said forward groove.

* * * * *